US005472241A

United States Patent [19]

Kosik, Jr. et al.

[11] Patent Number: 5,472,241

[45] Date of Patent: Dec. 5, 1995

[54] INTERIORLY INSTALLABLE EXTERIOR SURFACE MOUNT

[76] Inventors: Walter Kosik, Jr., 6 Craven Ter., Derry, N.H. 03038; Ronald E. Sousa, 9 Blackstone Cir., Pelham, N.H. 03076

[21] Appl. No.: 273,353

[22] Filed: Jul. 11, 1994

Related U.S. Application Data

[63] Continuation-in-part of Ser. No. 55,677, Apr. 30, 1993, Pat. No. 5,328,212.

[51] Int. Cl.[6] ..... E04D 13/00

[52] U.S. Cl. ..... 285/42; 285/43; 285/208; 52/199

[58] Field of Search ..... 285/42, 43, 208, 285/205, 44; 52/58, 60, 199, 200

[56] References Cited

U.S. PATENT DOCUMENTS

| | | | |
|---|---|---|---|
| 460,424 | 9/1891 | Bidwell | 285/43 |
| 862,415 | 8/1907 | Rohrer | 285/43 |
| 1,282,535 | 10/1918 | Bropson | 285/44 |
| 3,313,559 | 4/1967 | Kifer | 285/43 |
| 4,512,119 | 4/1985 | Willoughby | 285/43 |
| 4,570,943 | 2/1986 | Houseman et al. | 285/43 |
| 4,623,171 | 11/1986 | Wilson | 285/208 |
| 4,833,838 | 5/1989 | Van Dame | 52/22 |

*Primary Examiner*—Eric K. Nicholson

*Attorney, Agent, or Firm*—Daniel J. Bourque; David D. Lowry; Kevin J. Carroll

[57] ABSTRACT

An exterior surface mount for mounting a member such as a vent or pipe on an inclined roof or a wall of a building in which the member extends through an opening in the wall or roof. The mounting is disposable on the exterior of the wall or roof wholly from within the building. The mount includes an upper support or flashing member having a peripheral flange with dimensions that are larger than the opening so the flashing member covers completely the opening. The opening has one dimension larger than the smallest dimension of the flashing so that the flashing member can be slipped through the opening from the inside of the building and fitted on the outside of the wall or roof. A member receiving aperture is disposed within the flashing and is arranged to receive the vent or pipe. Gasketing is provided to seal any spaces between the aperture and the exterior of the member. An interior mounting device, such as a flange with fasteners or clamps, is disposed within the building to secure the flashing to the interior of the wall or roof from within the building. A seal or gasket is disposed between the peripheral flange and the exterior and is compressible to prevent the flow of water into the interior of the building from the exterior surface.

22 Claims, 5 Drawing Sheets

INTERIORLY INSTALLABLE EXTERIOR SURFACE MOUNT

RELATED APPLICATION

This application is a continuation-in-part of U.S. patent application Ser. No. 08/055,677, entitled INTERIORLY INSTALLABLE ROOF MOUNT and filed Apr. 30, 1993 issued on Jul. 12, 1994 as U.S. Pat. No. 5,328,212 which is fully incorporated herein by reference.

FIELD OF THE INVENTION

The present invention relates to an interiorly installable seal and support for pipes, vents, flues and other similar members that extend through an inclined roof or wall of a building. More particularly, the present invention relates to a mount that can be fitted on the exterior of the roof or wall wholly from inside the building in which it is being installed. The invention especially relates to simplified installation of a vent pipe seal and steadying device which does not necessitate climbing ladders, installing roof jacks or using strips of flashing.

BACKGROUND OF THE INVENTION

Mounts for vent pipes are well known to the art and the prevention of leakage past these mounts is also well known. U.S. Pat. No. to Holt, 969,476, discloses a mount for vent pipes which includes a tapered ring that fits within an internally tapered collar. A set of bolts engage the ring and force it into the collar and simultaneously compress a sealing ring to hold a tubular member in place. The device, however, must be mounted from the outside of the roof.

U.S. Pat. No. to Kifer, 3,313,559, discloses a roof flashing with an elastomeric collar in which a flange around the collar can be disposed beneath a course of shingles and the flashing can be nailed in place to hold a tubular member. External mounting of the flashing is required for the disposition of the collar.

Similarly with the roof flange disclosed by Gasstaffesen, U.S. Pat. No. 3,677,576, exterior mounting of the flanging is required. The U.S. Pat. No. to Lane, 4,897,974, discloses a vent pipe roof mount which is attached to the inclined roof through the use of straps and brackets that are fitted from the outside roof. U.S. Pat. No. to Jean-Jaques, 4,965,971 discloses a roof mounting for a pipe in which the flange can be mounted at any angle for universal fitting on roofs of many different pitches and still prevent the seepage of water into the building.

SUMMARY OF THE INVENTION

The broad purpose of the present invention is to provide a mount on an exterior surface of a building, for sealing and generally supporting or steadying a member, such as a hollow tubular member, in a wall or roof of the building in which the member extends through an opening in the wall or roof that is larger than the member. The mounting is inserted and installed on the exterior surface of the wall or roof from within the building and does not require the installer to climb or otherwise access the exterior of the building to install it.

The mount includes an exterior surface mount outer support member or flashing that has a peripheral flange with dimensions that are larger than the opening that the installer has cut in the wall or roof to install the tubular member. One dimension (length or width) of the opening must be larger than the smallest dimension of the outer support mender or flashing. The flashing is adapted to be slipped through the opening from the inside of the building by the installer to the outside of the wall or roof. When installed, the flashing completely covers the opening. A member receiving aperture is disposed within the flashing and a gasket is provided between the exterior of the member and the aperture to prevent leakage.

The exterior surface mount further includes an interior mounting clamp which is operable from the interior of the building and provides sufficient pounds per square inch (psi) of clamping force to securely hold the outer support member or flashing to the exterior surface. In one embodiment, a lower flange having a central aperture is used to receive the member and secure the flashing in place. The lower flange is disposed inside the building and engages the interior of the wall or roof. Other embodiments of the interior mounting clamp include two clamping bars extending along sides of the opening or a series of individual clamps spaced along sides of the opening.

The exterior surface mount preferably uses certain geometrical shapes such as ovals, rectangles or squares which can cover an opening cut in the roof. The shapes are such that the flashing can be moved from the inside of the building to the outside and then fitted against the exterior surface, such as shingles on the roof, to provide a seal. In a preferred embodiment, at least one side of the outer support member or flashing is rounded to facilitate water run-off.

Once through, the flashing is set down on the exterior surface of the wall or roof where the clamp can be attached. A gasket or seal is positioned beneath the peripheral flange of the flashing adjacent the exterior surface. Preferably, the clamping force sufficiently compresses the gasket to provide a watertight seal.

In some embodiments, it is possible to extend the upper portion of the flashing device sufficiently so that the upper portion can be disposed beneath a portion of a course of shingles on a roof to provide for a watertight seal whereby water easily runs over the watertight seal.

Accordingly a principle object of the present invention it so to provide a mounting for a member such as a tubular member which can be installed wholly from within the interior of a building while producing a watertight seal.

The other objects, features and advantages which will become subsequently apparent when considering the details of construction and operation as fully hereinafter described and claimed with reference to the accompanying drawing which form a part hereof.

DESCRIPTION OF THE DRAWINGS

For a further understanding of the nature and desired objects of the present invention reference should be made to the following detailed description taken in conjunction with the accompanying drawings wherein like reference characters denote corresponding parts throughout several views and wherein.

DETAILED DESCRIPTION OF THE PREFERRED EMBODIMENT

Figure 1:
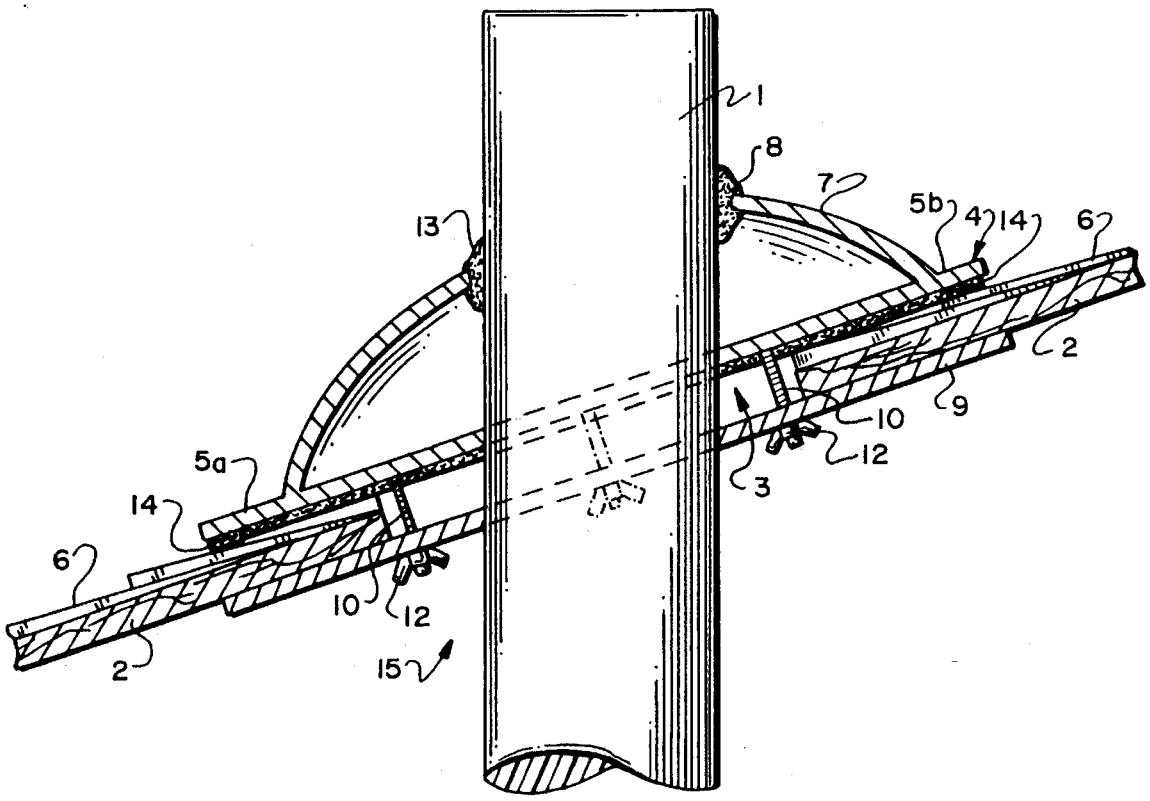
FIG. 1 is a cross-sectional view of an exterior surface mount mounted to an exterior surface of a building and supporting a hollow member in an opening in the building according to the present invention.

Referring to FIG. 1 the exterior surface mount supports a member 1 such as a hollow tubular member generally utilized as a plumbing stack or flue vent. The exterior surface mount is disposed on a wall or roof 2 of a building in which the hollow or tubular member extends through an opening 3 in the wall or roof. The exterior surface mount is adapted to mount on any type of exterior surface of a building. Such surfaces include, but are not limited to, a flat wood or metal surface or a shingled surface having wood or asphalt shingles.

The opening 3 is larger than the tubular member 1 so that it can be easily moved into position. The mount is disposed on the exterior surface of the wall or roof 2 and is disposable thereon wholly from within the building.

The exterior surface mount includes an exterior surface mount outer support member or flashing device 4 having peripheral flange sections 5*a* and 5*b* with dimensions that are larger than the opening. The flashing 4 is adapted to be slipped through the opening 3 from the inside of the building. In one embodiment, one dimension (length or width) of the opening 3 is larger than the smallest dimension of the outer support member or flashing 4. Thus, the smallest dimension of the flashing 4 is inserted through the opening 3 and the flashing is then positioned from within the building to completely cover the opening 3. Alternatively, if the outer support member of flashing 4 is made of a flexible resilient material, the flashing may be bent or flexed to fit through the opening 3 in the building. The flashing 4 should have a square, rectangular, oval or any shape which can be passed through the opening 3 from the inside to be seated on the outside of the wall or roof 2.

In one embodiment, the flashing is disposed on a roof having shingles and the peripheral flange sections 5*a* and 5*b* can be arranged either on top of shingles 6 or the upper portion 5*a* of the flange can be fitted beneath one course of the shingles 6. In that event, water will flow directly over the shingles onto the top of the flange 5*a* and around the mount.

A raised section 7 is centrally formed within the or flashing 4. The raised section 7 can be generally spherical or may be tapered with a flat inclined surface starting adjacent the peripheral flange sections 5*a* and 5*b*.

The exterior mount outer support member or flashing 4, in one embodiment, includes a seal or gasket 14 disposed beneath peripheral flange sections 5*a* and 5*b*. The seal or gasket 14 is positioned against the exterior surface of the wall or roof 2 to seal the flashing 4 against the exterior surface. The gasket 14 may include a tape gasket which has a cross section of approximately ¼"×¼" or a bead of caulking or roof cement, epoxy, polyblends or other sealers or bonding adhesives and agents.

A member receiving aperture 8 is formed within the upper flashing 4. Preferably the aperture 8 has a shape which is substantially the same as the shape of the member 1 with a slightly smaller diameter. To prevent the leakage of water between the member 1 and the aperture 8, a seal 13 is provided around the aperture. The seal 13 can be a collar which is set around the edges of the aperture 8 or an integral part of flashing 4 and may be made of a self-sealing material the flashing member itself can provide the seal by virtue of being smaller in diameter than the member 1.

The exterior surface mount further includes an interior mounting device for clamping and securing the outer support member or flashing 4 to the walls or roof of 2 of the buildings from the interior of the building. In one embodiment, the interior mounting device includes an interior mounting clamp 15 includes any clamping mechanism which is operable from within the building and which provides sufficient pounds per square inch clamping force to adequately secure the flashing to the outer surface of the walls or roof 2. In one preferred embodiment, the clamping force is approximately at least two-hundred pounds per square inch (200 psi) to adequately secure the flashing 4 to the wall or roof and to prevent water leakage between the flashing 4 and the exterior surface of the wall or roof 2.

In one embodiment, the interior mounting clamp 15 includes an interior surface clamping member lower flange 9 disposed on the opposite side of the wall or roof 2 and arranged to engage the interior of the wall or roof. In the embodiment shown in FIG. 1, the lower flange 9 has a generally rectangular shape which coincides with the shape of the upper flashing 4. A central opening is provided in the lower flange 9 to receive the member 1. If the outside perimeter of the upper flashing 4 has a generally oval shape then the lower flange 9 should have a generally oval shape also, to provide for easy securing of the mount. Other embodiments of interior surface clamping members include clamping bars or individual clamping members spaced along the side of opening 3, as will be described in greater detail below.

Many different types of fasteners may be used to fasten lower flange 9 or other clamping members to the flashing 4 and secure the mount to the building. In the illustrated embodiment, the fasteners include bolts 10 that are fixedly attached to the upper flashing 4. Suitable nuts, for example wing nuts 12, are threaded on bolts 10. Washers (not shown) are disposed between the wing nuts 12 and the lower flange 9. Tightening the wing nuts 12 uniformly around the lower flange 9 will squeeze peripheral flange of the upper flashing 4 against the shingles 6 and also squeeze the gasket 14 against the shingles 6 to provide the preferred clamping force and a watertight seal. As has been set out above, in one embodiment the upper end of 5*a* of the flashing 4 can be disposed beneath a course of shingles 6.

Alternative embodiments Of the interior mounting clamp 15 also include interior surface clamping members which are already fastened to the bottom of the flashing 4 when the flashing 4 is inserted through the opening 3. These clamping members may be pivoted or rotated to abut the interior surface of the wall or roof 2 after the flashing 4 has been positioned against the exterior surface. The clamping members may then be tightened or may be spring biased to provide the preferred clamping force and secure the flashing 4 to the walls or roof 2.

Figure 2:
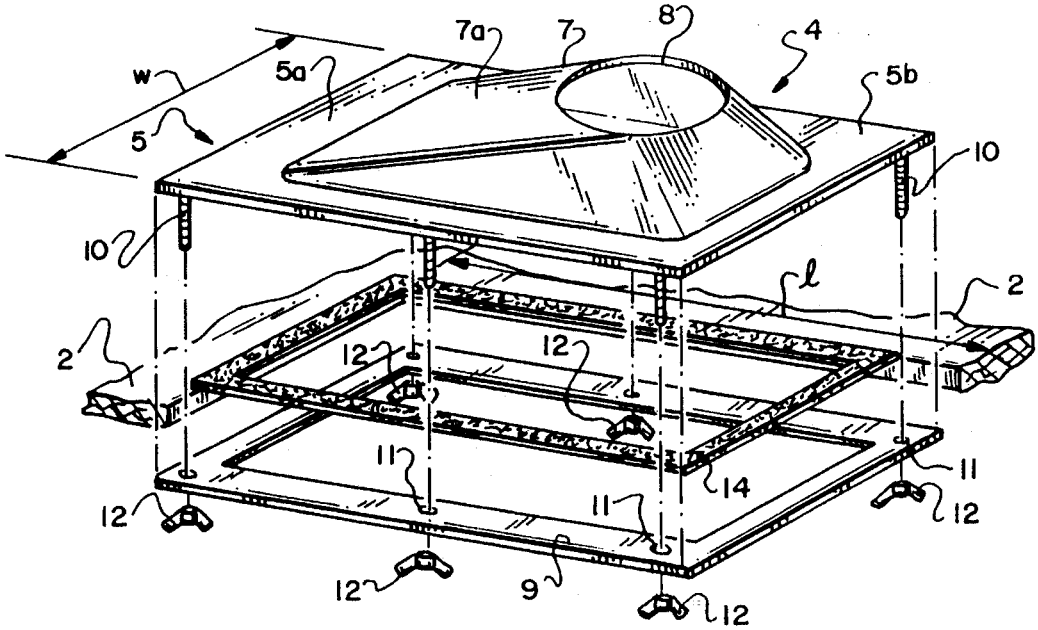
FIG. 2 is an exploded perspective view of an exterior surface mounting according to the present invention.

Turning now to FIG. 2, an exploded view of the exterior surface mount is shown. The mount includes the outer support member or flashing 4 with a peripheral flange 5 having a width w shorter than a length l of the opening 3. A raised section 7 is formed on the flashing 4 and can be shaped with a planar surface 7*a* that rises from the peripheral flange 5*a* to the aperture 8. This arrangement enables the water to flow around the aperture 8 more easily and avoids leakage and is also decoratively pleasing. Bolts 10 extend from the peripheral flange 5 and are adapted to be fitted into holes 11 in lower flange 9 that are formed to receive them. The gasket 14 is adapted to seat against the exterior surface when the wing nuts 12 are tightened upon the bolts 10.

Figure 3:
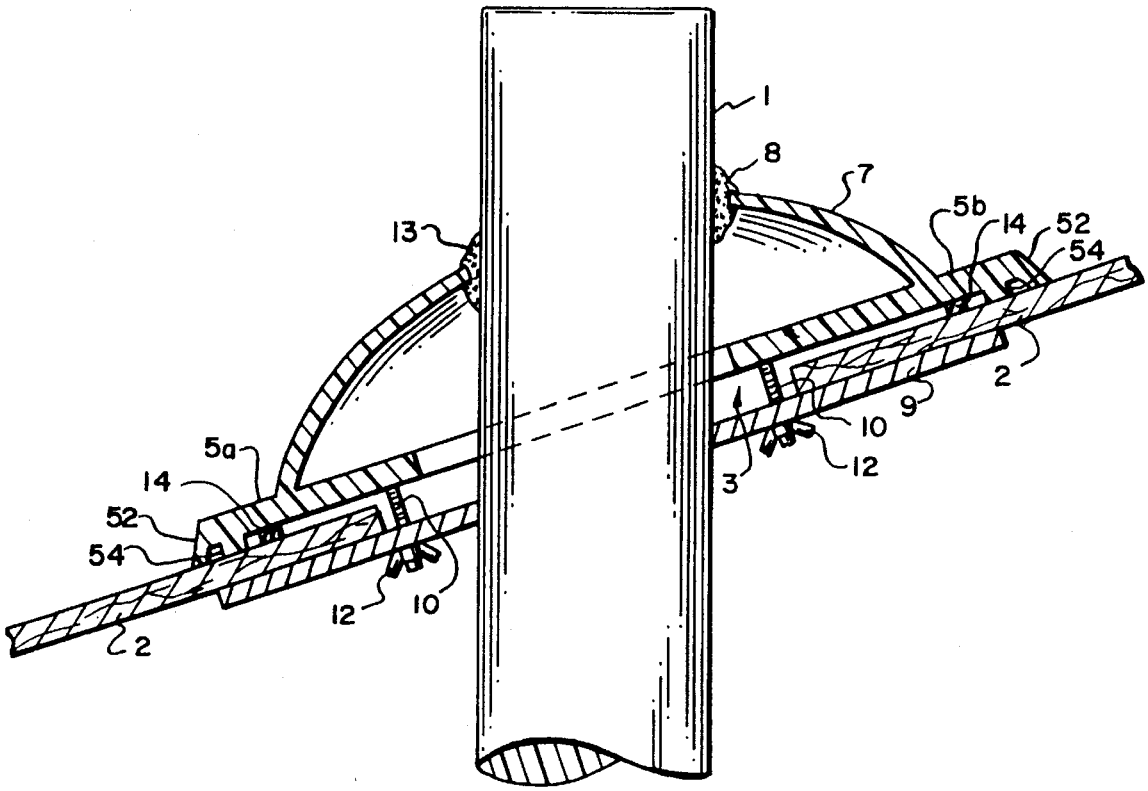
FIG. 3 is a cross-sectional view of an exterior surface mount mounting a hollow member in an opening of a building according to an alternative embodiment of the present invention.

In a preferred embodiment, FIG. 3, the outer support member of flashing 4 includes a peripheral flange 5 which has flared or tapered sides 52 extending from a top surface of the flange to the exterior surface of the wall or roof 2. The flared or tapered sides 52 of flange 5 allow water to run from the exterior surface over the peripheral flange 5 preventing leakage beneath the flashing 4 and into the opening 3 of the building.

In a preferred embodiment, the outer support member or flashing member 5 is molded from a liquid resistant material, such as rubber or neoprene, and a seal 54 is molded as one piece with the flashing 4 although an aluminum stamped member with a rubber seal is also contemplated. The molded seal 54 extends around the periphery of flange 5 and is positioned against the exterior surface of walls or roof 2 when mounting the flashing 4. The molded seal 54 is compressed against the exterior surface when the flashing 4 is clamped to the walls or roof 2 and provides a watertight seal for protection against water leakage into the opening 3. The molded seal 54 may be used by itself to provide the water tight seal, or a secondary seal or gasket 14 may also be provided and positioned between the peripheral flange 5 and the exterior surface to provide additional protection against water leakage. The secondary seal or gasket 14 may include a tape gasket, caulking, roof cement or other similar type of bonding adhesive or agent.

Figure 4:
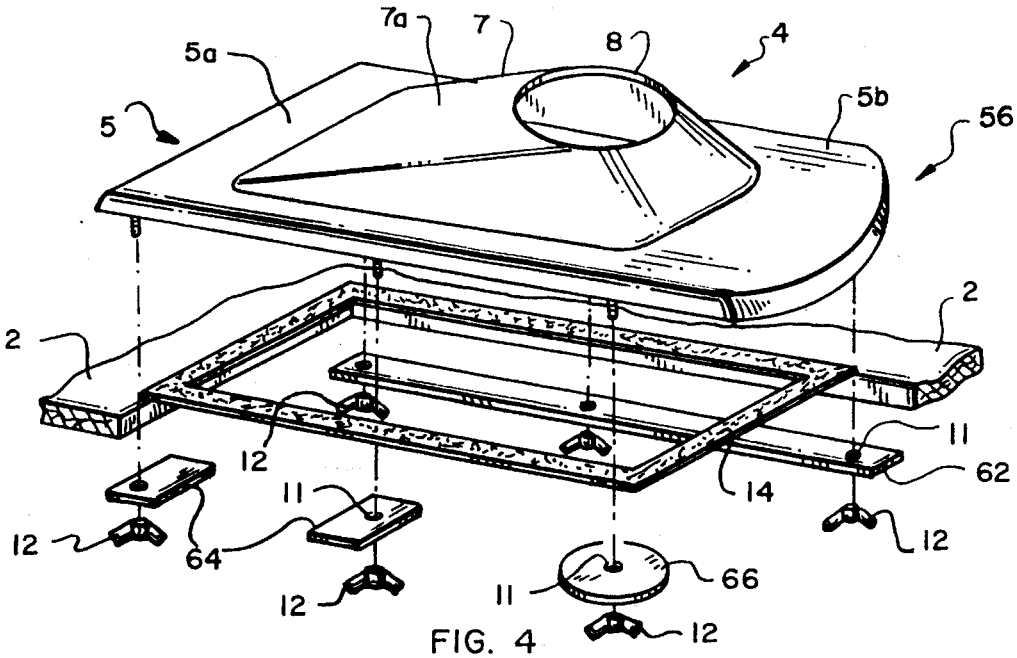
FIG. 4 is an exploded perspective view of the exterior surface mount according to an alternative embodiment of the present invention.

An alternative preferred embodiment, FIG. 4, of the outer support member or flashing 4 includes at least one rounded or arcuate portion 56 on at least one edge or section of the peripheral flange 5, for facilitating water run off. Preferably, the rounded side portion 56 is formed on a section of the flange 5 which is faced against the direction of water run off, e.g. facing upwardly on an inclined roof or wall. The rounded side portion 56 provides further assurance that water will flow around the flashing 4 and not leak beneath the flashing 4 and into the opening 3.

Alternative embodiments of the interior surface clamp 15 include various types of interior surface clamping members 62, 64, 66 which are fastened to the flashing 4 and positioned against the interior surface of the wall or roof 2. In one embodiment, clamping bars 62 extend along at least two sides of the opening 3 to clamp the flashing 4 to the wall or roof 2. Also, a series of individual clamping members, such as rectangular clamping members 64 or clamping washers 66, may be spaced along sides of the opening 3 to provide the necessary clamping force for securing the flashing 4 to the wall or roof 2. Any combination of these clamping members with any type of fastener is possible as long as sufficient pounds per square inch (psi) in clamping force is generated to support the member 1 and to prevent leakage.

Figure 5:
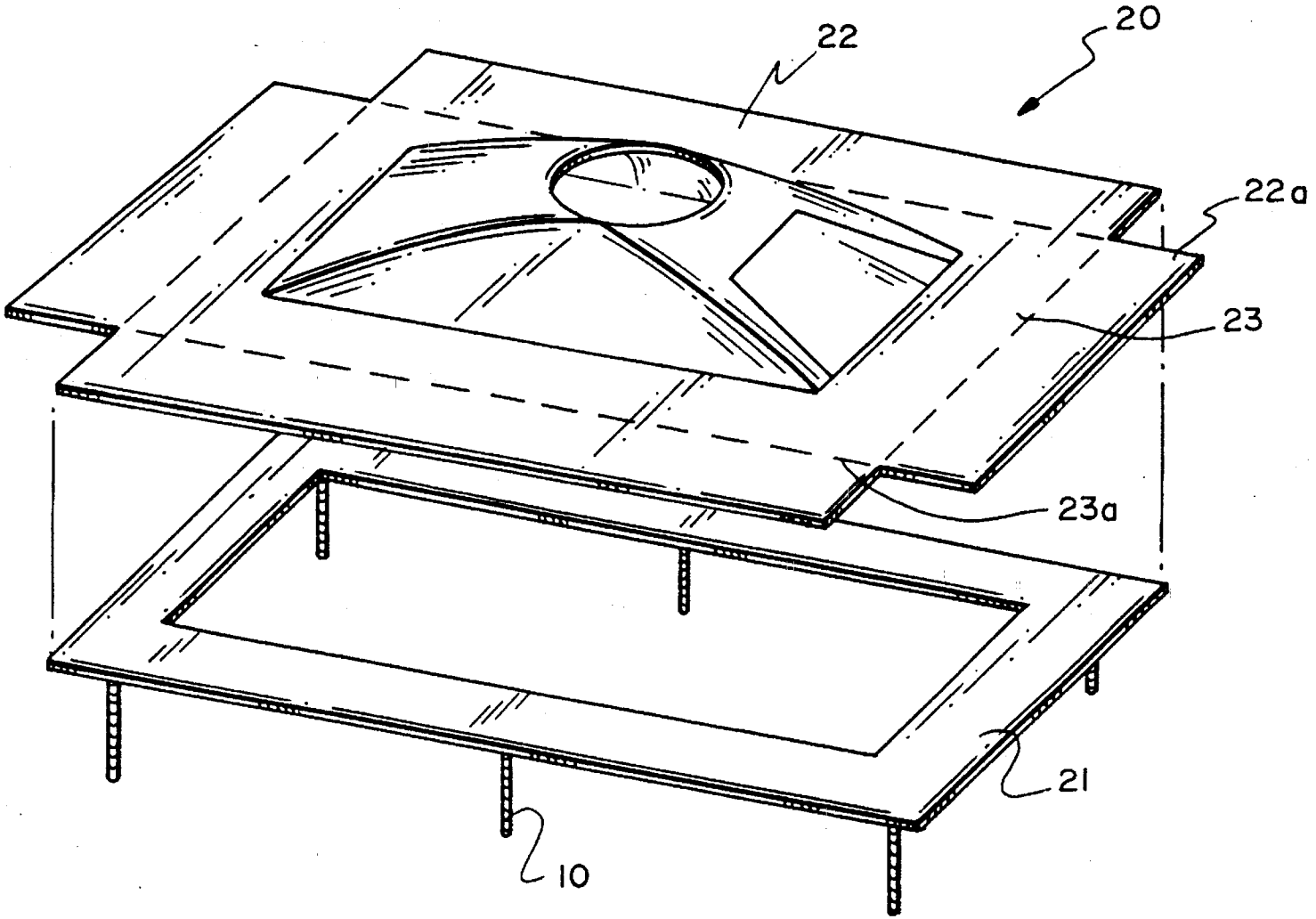
FIG. 5 is an exploded perspective view similar to that shown in FIG. 1, with a soft material disposed over a rigid substrate.

Referring now to FIG. 5, another embodiment of the present invention is disclosed. In this embodiment the upper flashing is formed of two pieces, an exterior sheath 20 and a base support 21. The bolts 10 are attached to the base support 21 and flanges 22 and 22*a* are disposed around the perimeter of the exterior sheath 20. The flanges 22 and 22*a* are bendable on lines 23 and 23*a* and are arranged to be folded over and under. In this way a relatively inexpensive but aesthetically pleasing outer sheath 20 can be used for the peripheral flange while the base support 21 provides structural integrity to the unit. In all other aspects of the use and disposition of the upper flashing is the same as the upper flashing disclosed with reference to FIG. 1. The exterior sheath 20 can be a more simple material such as neoprene rubber or plastic.

Figure 6:
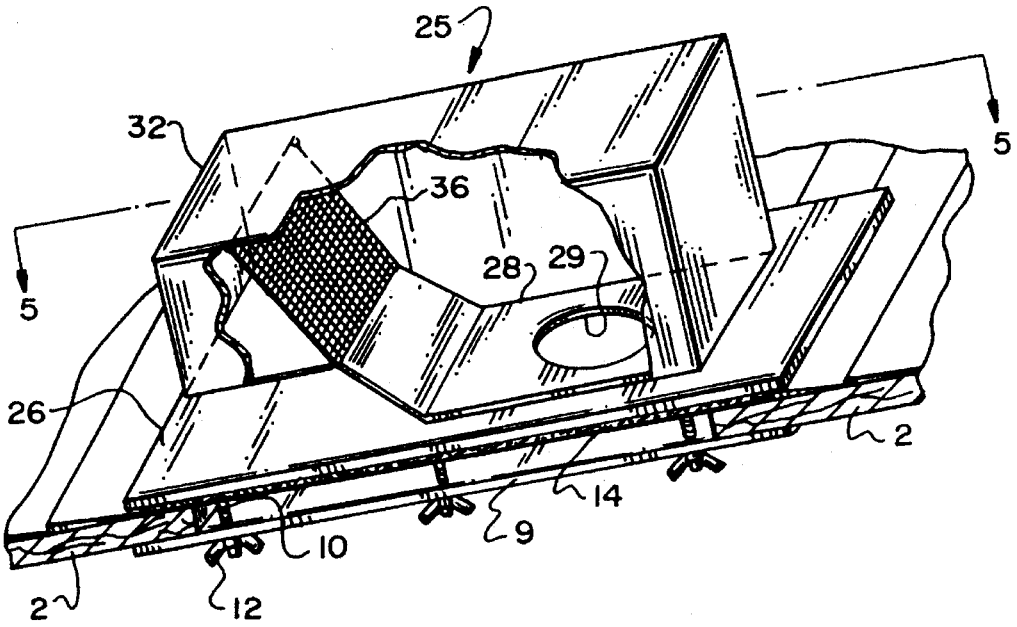
FIG. 6 is a fragmentary perspective view of an alternate embodiment of the mounting device of the present invention.
Figure 7:
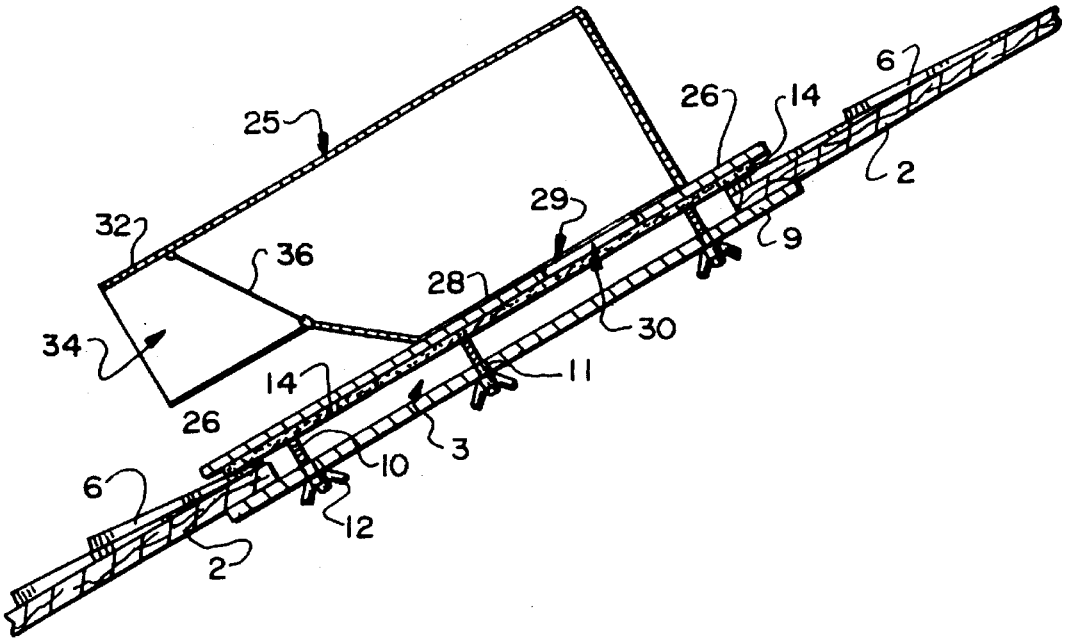
FIG. 7 is a cross-sectional view taken along the line of 5—5 of FIG. 4.

Referring now to FIGS. 6 and 7, there is illustrated another embodiment of the present invention. The exterior surface mount includes an outer venting container member 25 and a mounting flashing flange 26 to which the bottom portion 28 of the container 25 is attached. The bottom portion 28 has an opening 29 which meets the opening 30 of the flashing flange 26 which contacts the wall or roof structure where a pipe or fitting can be attached to provide a selected vent such as an air vent, attic vent, dryer vent, fresh air vent or other air devices which require exhaust or intake of air. In this embodiment the forward end portion 32 of the container 25 is raised up with an open end section 34. Attached within the upper forward end section 32 is a screen device 36 for the opening 29 and 30. As illustrated, the upper forward section 32 of the container 25 faces the downward side of the roof pitch 2. In all other respects the securing of the container 25 is similar to that of FIGS. 1 and 2.

Figure 8:
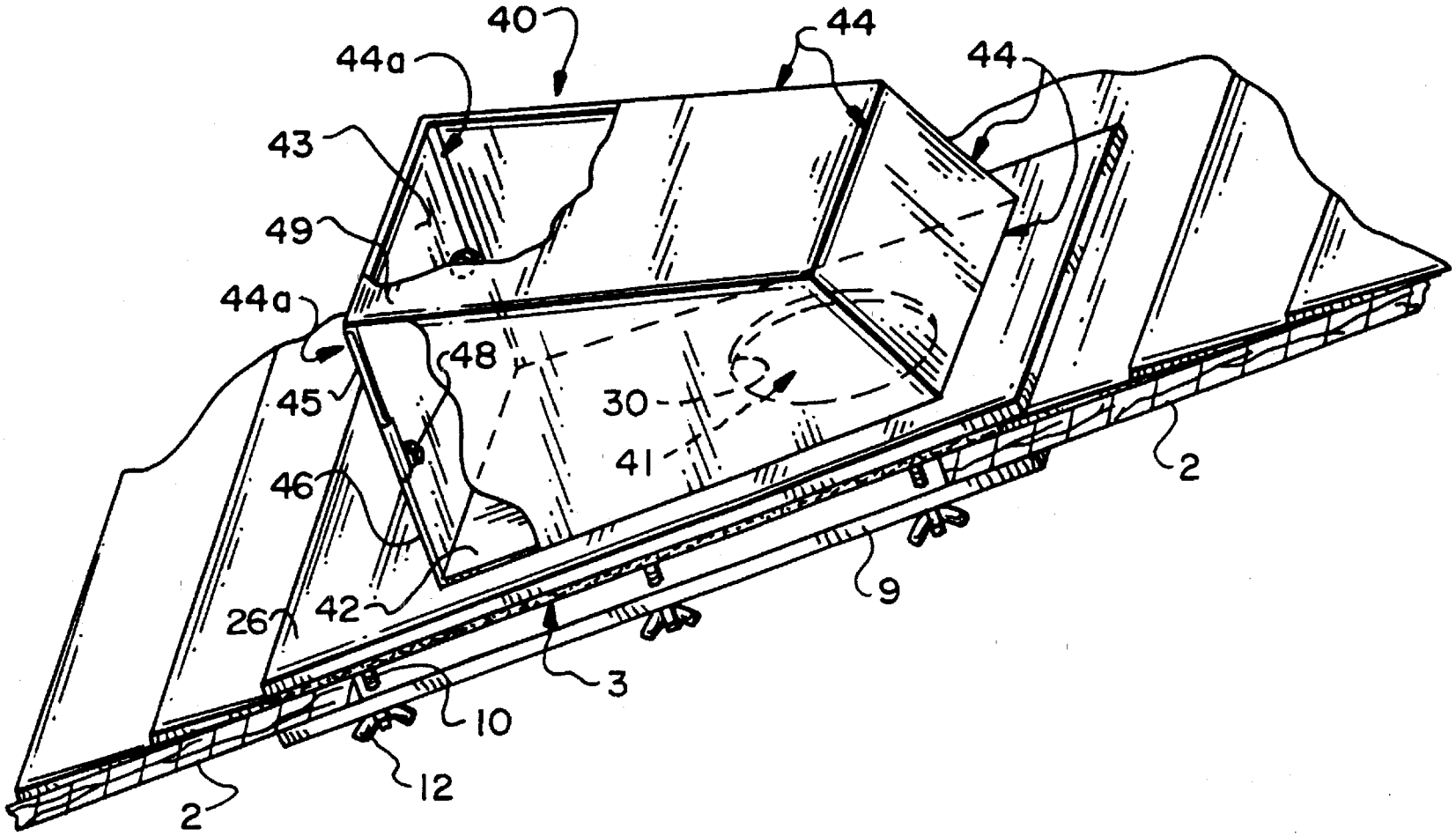
FIG. 8, is a fragmentary perspective view of a alternate embodiment of the mounting device of the present invention.

Referring now to FIG. 8, there is illustrated another embodiment of the present invention. The exterior surface mount is similar to that of FIG. 4 except that it contains an alternate embodiment of an outer venting container 40 which is preferably formed of a flexible liquid resistant material such as rubber. The venting container 40 with an opening 41 in the bottom portion 42 which is attached to the flashing flange 26 and contacts the opening 30 of the flashing flange 26.

The venting container 40 has a forward open section 43 which permits exhaust or intake of air. The venting container 40 includes inner liner member 44 which extends about the inner edge surfaces of the venting container 40. The vertical forward liner members 44A are formed of two vertical telescoping members 45 and 46 which are adjustable up and down by the suitable bolt means 48. With respect to the forward liner sections 44A the liquid resistant cover material 49 is attached only to the outer side of the upper section 45. In this matter, the higher forward portion forming the open section 43 can be lower to permit the venting container to be easily inserted through the opening 3 when attached to the flashing flange 26. After the flashing flange 26 is attached to the wall or roof section, the operator's hand can be inserted through the opening 41 and secure the forward portion of the cover device 40 in a selected upper position.

While nuts and bolts are the preferred mechanisms for attachment of the lower flange 9 to the upper flashing 4 other mechanisms can involve a U-channel that is attached to the underside of the upper flashing. The U-channel is open on the bottom to accept a locking screw and a securing tab. A J-channel is attached to the top flashing flange and will accept a lower securing hooking screw. With regard to the gasket it can be made of conventional gasket material such as resilient rubber or neoprene and it can be attached or molded to the bottom of the upper flashing flange or it can be applied at the time of insulation. On walls or roofs with irregular surfaces a small amount of bonding adhesive or caulking can be applied to either side of the gasket or the roof to secure attachment.

While the invention has been described with respect to preferred embodiments, it will be apparent to those skilled in the art that changes and modifications may be without departing from the scope of the invention herein involved in its broader aspects. Accordingly, it is intended that all matter contained in the above description or shown in the accompanying drawing shall be interpreted as illustrative and not in limiting sense.

What is claimed is:

1. An exterior surface mount disposable on an exterior surface of a structure wholly from within the structure, and for supporting a member in an opening of the structure, said member extending from an interior of said structure through said opening to an exterior of said structure, said exterior surface mount comprising:

an exterior surface mount outer support member for supporting said member in said opening, said outer support member having a peripheral flange with dimensions sufficient to completely cover the opening in the structure, said peripheral flange dimensions including a first peripheral flange dimension which is smaller than one dimension of the opening, wherein said exterior surface mount outer support member is insertable through the opening from the interior of the structure for positioning said exterior surface mount outer support member on the exterior surface of the structure;

at least one outer support member seal, disposable between said peripheral flange and the exterior surface of the structure, for preventing flow of fluids between said peripheral flange and the exterior surface of the structure into the opening of the structure;

a member receiving aperture disposed within said exterior surface mount outer support member, for receiving the member to be supported;

a member receiving aperture seal adapted to be disposed around said member receiving aperture, for preventing the flow of fluid between said exterior surface mount outer support member and said member; and an interior mounting clamp operable from the interior of the structure, for clamping said exterior surface mount outer support member to the exterior surface of the structure from the interior of the structure, said interior mounting clamp adapted to provide a clamping force sufficient to support the member in said exterior surface mount outer support member and to prevent fluid flow between said peripheral flange and the exterior surface of the structure.

2. The exterior surface mount of claim 1, wherein said exterior surface mount outer support member has a substantially rectangular shaped peripheral flange, for inserting into and completely covering a rectangular shaped opening having a smaller area than said rectangular shaped peripheral flange and one side larger than a smallest side of said substantially rectangular shaped peripheral flange.

3. The exterior surface mount of claim 1, wherein said peripheral flange of said exterior surface mount outer support member includes at least one arcuate side portion.

4. The exterior surface mount of claim 1, wherein said peripheral flange of said exterior surface mount outer support member includes a tapered edge portion extending from a top surface of said peripheral flange to a bottom surface of said peripheral flange.

5. The exterior surface mount of claim 1, wherein said at least one outer support member seal includes primary a sealing portion which is one-piece with said peripheral flange and disposed on a bottom surface of said peripheral flange, for abutting the exterior surface of the structure.

6. The exterior surface mount of claim 5, wherein said at least one peripheral flange seal further includes a secondary seal gasket secured to said bottom surface of said peripheral flange adjacent said sealing portion.

7. The exterior surface mount of claim 1, wherein said exterior surface mount outer support member includes a raised section disposed centrally of said peripheral flange, and wherein said member receiving aperture is disposed centrally of said raised section.

8. The exterior surface mount of claim 1, wherein said interior mounting clamp includes at least one interior surface clamping member and at least one fastener, for fastening said at least one interior surface clamping member to said exterior surface mount outer support member and for providing said clamping force.

9. The exterior surface mount of claim 8, wherein said at least one interior surface clamping member includes a lower flange adapted to be positioned on the interior surface of the structure around the opening of the structure and to be fastened to said exterior surface mount outer support member, for clamping said exterior surface mount outer support member to the structure.

10. The exterior surface mount of claim 8, wherein said at least one interior surface clamping member includes a plurality of clamping bars adapted to be positioned against the interior surface of the structure along at least two sides of the opening of the structure and to be fastened to said exterior surface mount outer support member, for clamping said outer support member to said structure.

11. A method of mounting a member in a structure so that said member extends from an interior of the structure to an exterior surface of the structure, said method comprising the steps of:

inserting an exterior surface mount outer support member through an opening in the structure from the interior of the structure;

positioning said exterior surface mount outer support member against an exterior surface of the structure so that said exterior surface mount outer support member completely covers the opening of the structure;

positioning at least one interior mounting device against the interior surface of the structure; and securing said exterior surface mount outer support member to the structure from the interior of the structure with said at least one interior mounting device.

12. The method of claim 11, further including the step of:

inserting a hollow member through the opening in the structure and through a hollow member receiving aperture in said exterior surface mount outer support member.

13. The method of claim 11, wherein said exterior surface of said structure includes a roof of a building.

14. The method of claim 11, wherein said exterior surface of said structure includes a wall of a building.

15. The method of claim 11, wherein said step of positioning said exterior surface mount support member includes the step of positioning a peripheral flange of said exterior surface mount support member below a course of shingles on said roof of said building.

16. The method of claim 11, wherein said step of inserting an exterior surface mount outer support member through an opening in said structure from an interior of said structure includes the step of arranging said exterior surface mount outer support member so that a smallest dimension of said exterior surface mount outer support member fits between a dimension of the opening which is larger than said smallest dimension of said exterior surface mount outer support member.

17. The method of claim 11, further including the step of providing an outer support member seal between said exterior surface mount outer support member and the exterior surface of the structure.

18. The method of claim 17, wherein said step of securing said exterior surface mount outer support member to said structure includes the step of providing a clamping force sufficient to create a watertight seal between said outer support member seal, said exterior surface mount support member and the exterior surface of the structure.

19. The method of claim 12, further including the step of sealing the hollow member to the exterior surface mount outer support member around the hollow member receiving aperture.

20. An exterior surface mount for supporting an outer venting container member communicating with a vent device extending through an opening in a structure larger than the vent device, said exterior surface mount comprising:

an exterior surface mount outer support member having a peripheral flange with dimensions larger than the opening in the structure, wherein said exterior surface mount outer support member is adapted to be slipped through the opening from an interior of the structure and to be fitted on the exterior of the structure to completely cover the opening, said exterior surface mount outer support member including a surface-engaging side and an exterior side;

a vent device receiving aperture disposed within said exterior surface mount outer support member for receiving said vent device;

a vent device seal disposed around said vent device receiving aperture, for sealing any spaces between said vent device receiving aperture and said vent device;

an outer venting container member attached to said exterior side of said exterior surface mount outer support member and having a rearward portion and an open forward portion, said rearward portion having a bottom opening adapted to contact said vent device;

an interior mounting device operable from the interior of the structure, for securing said exterior surface mount outer support member to the exterior surface of the structure; and an outer support member seal disposed on said peripheral flange of said exterior surface mount outer support member, for providing a watertight seal between said exterior surface mount outer support member and the exterior surface of the structure.

21. The exterior surface mount of claim 20, wherein said outer venting container member includes a screen device disposed proximate said open forward portion and between said open forward portion and said bottom opening of said rearward portion.

22. The exterior surface mount of claim 20, wherein said outer venting container member includes upper and lower vertical adjustable side members proximate said open forward portion, for expanding said upper venting container member and opening said open forward portion when said exterior surface mount is positioned on the exterior surface of the structure.

* * * * *